United States Patent [19]

Jackson et al.

[11] Patent Number: 4,658,719

[45] Date of Patent: Apr. 21, 1987

[54] OVERSIZE BALE RELEASE MECHANISM FOR WASTE MATERIAL BALER

[75] Inventors: Jerry L. Jackson; Johnny B. Outen, both of Cordele, Ga.

[73] Assignee: Harris Press and Shear, Inc., Cordele, Ga.

[21] Appl. No.: 798,387

[22] Filed: Nov. 15, 1985

[51] Int. Cl.[4] ..... B30B 15/32

[52] U.S. Cl. ..... 100/218; 100/3; 100/14; 100/98 R; 100/232; 100/242

[58] Field of Search ..... 100/3, 14, 218, 242, 100/98 R, 246, 909, 191, 247, 232

[56] References Cited

U.S. PATENT DOCUMENTS

| | | | |
|---|---|---|---|
| 716,422 | 12/1902 | Hulscher | 100/246 X |
| 2,400,661 | 5/1946 | Struensee | 100/242 X |
| 2,763,201 | 9/1956 | Hauswirth | 100/191 X |
| 3,613,556 | 10/1971 | Wright | 100/3 X |
| 3,768,399 | 10/1973 | Martiniak | 100/218 X |
| 4,144,806 | 3/1979 | Broussard | 100/218 X |

*Primary Examiner*—Billy J. Wilhite

*Attorney, Agent, or Firm*—Cushman, Darby & Cushman

[57] ABSTRACT

A waste baling machine having a baling or compression chamber of generally parallelopiped configuration is provided with a charging passage leading thereto with the head of a charging ram reciprocable in the passage and normally forming, in one position, a wall of the chamber. A discharge passage leads from the chamber at right angles to the charging passage and the head of a discharge ram, which when retracted forms a wall of the chamber, is advancable through the chamber and the discharge passage to eject waste material compressed in the chamber by the charging ram, i.e. a bale. If the bale is oversize and protrudes back into the charging passage, a portion of the wall of the discharge passage which forms a part of the charging passage is moved to enlarge the discharge passage sufficiently to permit ejection of the oversize bale.

4 Claims, 5 Drawing Figures

OVERSIZE BALE RELEASE MECHANISM FOR WASTE MATERIAL BALER

FIELD OF THE INVENTION

This invention relates to machines for baling waste material, such as paper, cardboard, used beverage cans, and many other types of waste material, either of one kind or mixed. More particularly, this invention relates to improvements in the waste baling machine forming the subject matter of the patent to Wright et al. U.S. Pat. No. 3,613,556, Oct. 19, 1971, the disclosure of which is incorporated by reference herein.

BACKGROUND OF THE INVENTION

The machine disclosed in the Wright et al patent has an open-top waste-receiving hopper, generally rectangular in horizontal section, with a bottom or floor and opposed side walls. The head of a compression or charging ram, forming the lower portion of one end wall of the hopper, is movable through the lower portion of the hopper along its bottom to push waste material into and through a transfer or charging passage in the other end wall of the hopper which is aligned with and substantially conforms, in cross-section, to the elevational outline of the ram head. This charging passage leads to a compression or baling chamber from which the material compressed therein by the charging ram, i.e. a bale, is ejected through a discharge passage extending at right angles to the charging passage and tied to retain the material in a bale. Such ejection is accomplished by an ejection ram the head of which moves through the compression chamber and the discharge passage.

The machine normally is operated automatically, although manual control can be selected, and the compression or charging ram usually makes several excursions or cycles through the hopper and charging passage, and even overtravels into the compression or baling chamber itself to move waste material thereinto and compress it therein to a desired bale density before the bale is ejected. When that density has been attained, the compression ram moves to position its head at the exit end of the charging passage with the face of the head coextensive with a side wall of the discharge passage, to thus form a side wall of the compression chamber. The ejection ram then advances through the chamber in step-by-step movements to eject the bale through the discharge passage. Just outside the discharge passage, and surrounding it, is a tying mechanism which, when the bale pauses between its step-by-step ejection movements, encircles the bale with a strap or wire and ties the latter to retain the compressed material in its bale shape. The outer end of the discharge passage may be closed by a door during reciprocations of the charging or compression ram but a door is not essential because the compression ram moves at right angles to the direction of discharge of the bale and the latter plugs the discharge passage sufficiently to attain a desired bale density.

A problem exists, however, with the machine described above. On occasion the charging ram will move too much material into the compression or baling chamber so that the material protrudes back into the transfer passage and the compressed ram cannot be advanced to its normal bale-ejecting position, i.e. with the face of the head coextensive with a side wall of the discharge passage. In such event, the width of the bale will be greater than that of the discharge passage and the oversize bale cannot be ejected or pushed through the discharge passage by the ejection ram. Heretofore, to overcome such a situation, the compression ram is retracted and a man descends into the hopper to clear the jam, i.e. to pull sufficient material out of the charging passage and back into the hopper to permit the material remaining in the chamber to be ejected. Such a jam-clearing operation not only is time consuming and inefficient, however, but also dangerous. If the compression ram should be advanced, through accident, inadvertence or mistake, while a man is in the hopper, the result could be too horrible to contemplate.

BRIEF SUMMARY OF THE INVENTION

Accordingly, it is an object of this invention to provide simple mechanical means, either automatic or under the control of an operator, to enable an oversize bale to be ejected from the compression chamber of a waste material baler of the type described without the necessity of clearing a jam by hand.

This object is accomplished by making the side wall of the discharge passage adjacent the charging passage of greater than normal thickness and in two sections, one inner and one outer, divided parallel to the plane of the wall. The inner section is of considerable thickness and is movable or slidable so as to enlarge the discharge passage sufficiently to enable the ejection therethrough of an oversize bale. Movement of such inner wall section is accomplished by any suitable motor such as a linear hydraulic motor.

Other objects and advantages of the invention will become apparent from the following description and accompanying drawings in which.

DETAILED DESCRIPTION OF THE INVENTION

Figures 1, 5:
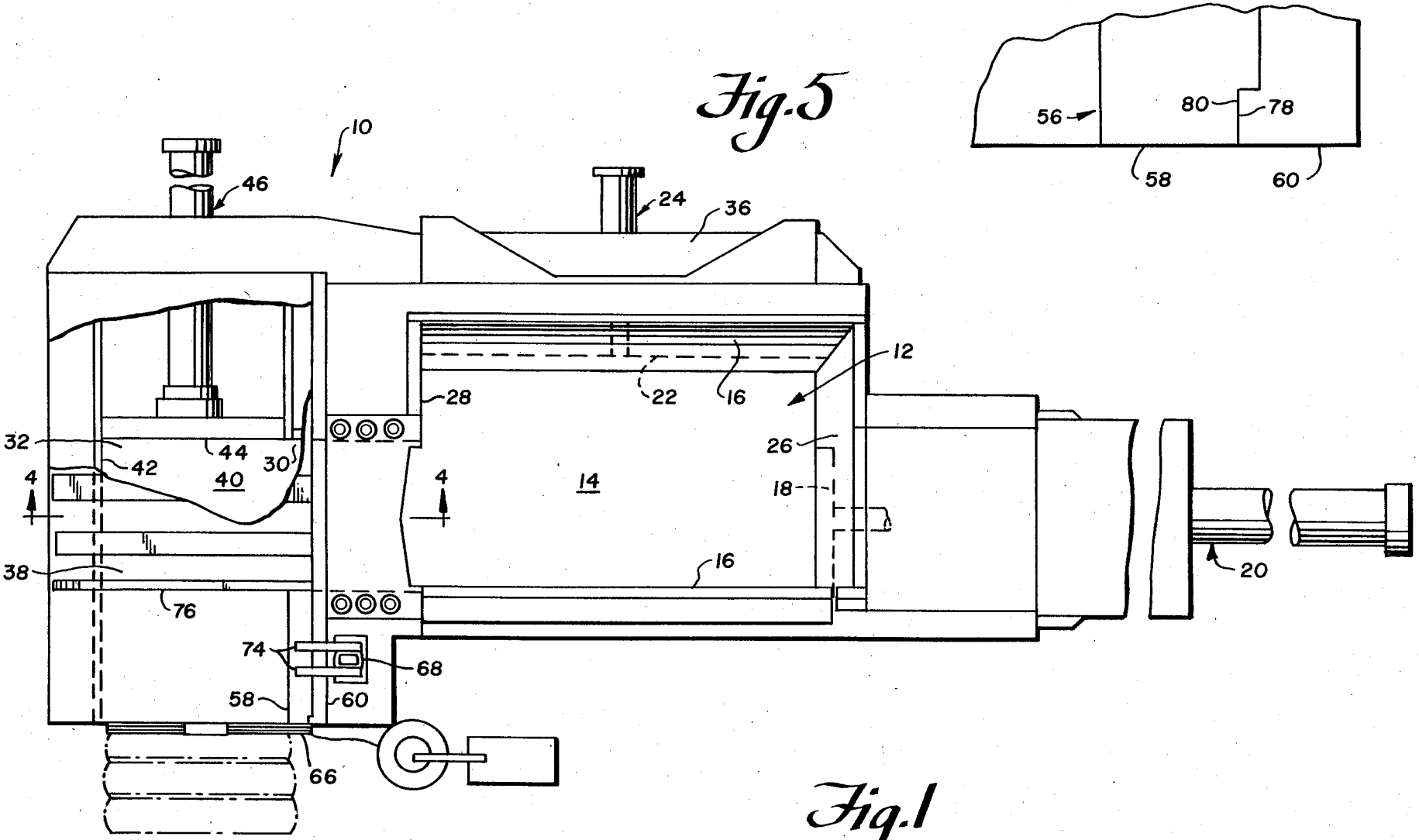
FIG. 1 is a plan view, with a portion of the top wall of the baling chamber removed, showing a waste baling machine embodying this invention.
FIG. 5 is an enlarged fragmetnary view of a portion of FIG. 2.
Figure 2:
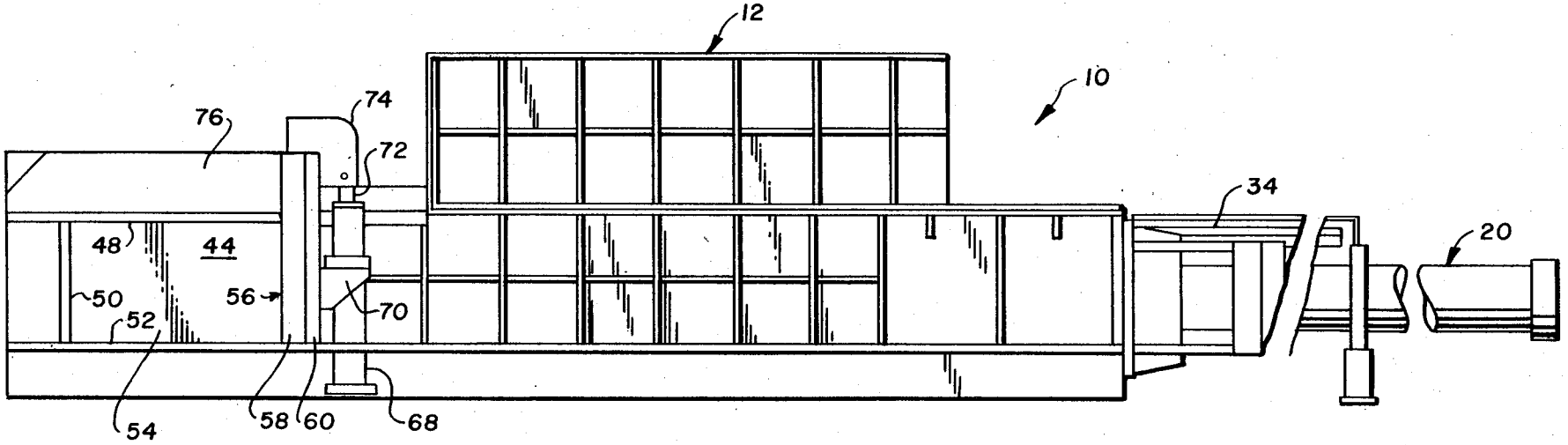
FIG. 2 is a front elevational view of the machine shown in FIG. 1, with the bale release mechanism in closed position.

Referring now to the drawings, there is shown a machine 10 for baling waste material, such as paper, cardboard, corrugated containers, used beverage cans, etc. The machine 10 has a hopper 12, into which waste material is loaded, that is generally rectangular in horizontal section. The hopper has a flat bottom or floor 14 and opposed side walls 16, the upper portions of at least one of which may incline outward and the lower portions of which preferably are vertical for passage horizontally therebetween, and along the floor 14, of the head 18 of a hydraulic charging or compression ram 20.

Figure 4:
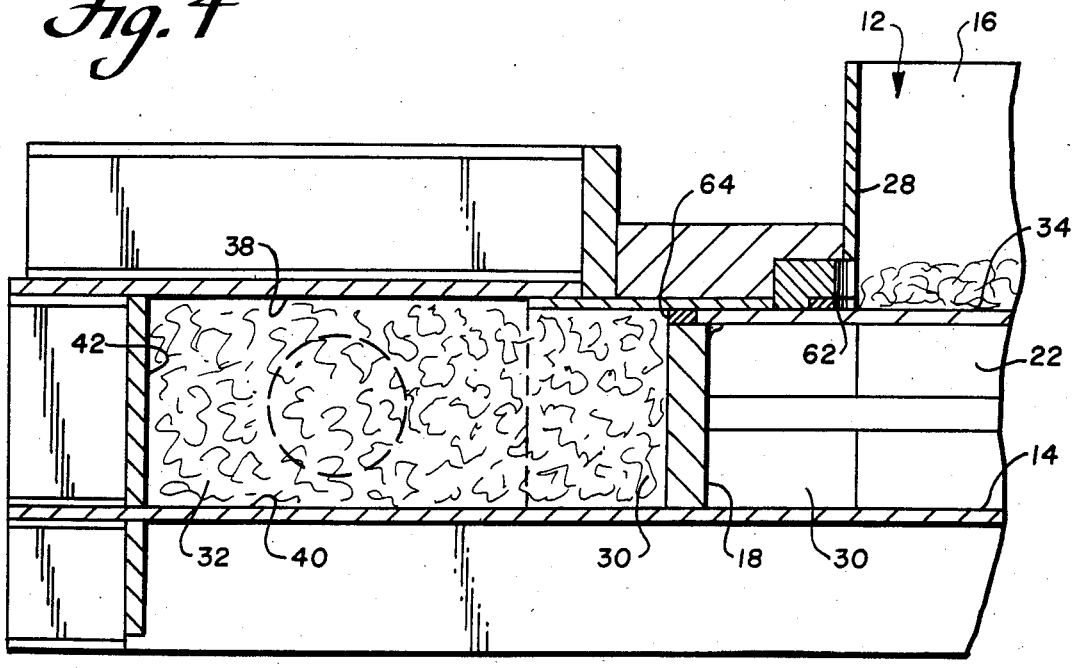
FIG. 4 is an enlarged sectional view taken on line 4—4 of FIG. 1.

In larger machines, the hopper may be laterally enlarged at one side and the lower portion of the corresponding side wall 16 may be formed by the head 22 (FIG. 4) of a lateral gatherer ram 24, which retracts to laterally enlarge the lower portion of the hopper 12 and extends to push waste material into the path of the charging ram head 18 and to position the head 22 flush with the side of the head 18 of the charging ram 20 on advance of the latter.

The end walls of the hopper 12 may be vertical with the upper portion of one end wall 26 being inclined outwardly and the lower portion being formed by the head 18, when retracted, of the charging ram 20. The lower portion of the other end wall 28 has a transfer or charging passage 30 extending therethrough in alignment with and conforming in vertical outline to the ram head 18. The passage 30 leads to a compression or baling chamber 32 of generally parallelopiped configuration.

Connected to and extending rearwardly from the upper edge of the ram head 18 is a cover plate 34 suitably slidably supported at its side edges and of sufficient length to cover the lower portion of the hopper 12 when the head 18 has advanced its full stroke into the compression or baling chamber 32. At this time the hopper 12 can be loaded again with waste material on top of the cover plate 34 which material is wiped off the cover plate by the upper portion of the end wall 26 and falls down into the lower portion of the hopper 12 as the ram head 18 retracts to thus provide another charge to be pushed into the baling chamber 32. A similar cover plate 36 is connected to and extends rearwardly from the upper edge of the gatherer ram head 22 to prevent waste material from falling behind that head 22 when it is advanced from its retracted position.

The compression chamber 32 has a fixed upper wall 38, a fixed floor 40, both substantially coextensive with the upper wall and floor of the charging passage 30, and a fixed side wall 42 opposite and spaced from the exit end of the charging passage. The chamber 32 also has an end wall defined by the head 44 of an ejection ram 46 which head, when retracted, usually is coextensive with a side wall of the charging passage 30 although the head may have an even more retracted position. The upper wall 38, floor 40 and side wall 42 are extended to form corresponding fixed walls 48, 50 and a fixed floor 52 of a discharge passage 54. The other side wall 56 of the discharge passage 54 is of greater than normal thickness and is divided into inner and outer sections 58, 60 parallel to the plane of the wall 56. The outer section 60 is fixed but the inner section 58 is quite thick and movable vertically for reasons later explained.

In use, after the hopper 12 has been filled with waste material and the gatherer ram 24 advanced, as explained above, the charging ram 20 is advanced to push waste material in the lower portion of the hopper through the charging passage 30 and into the compression chamber 32. Preferably, the upper edge of the inlet end of the charging passage 30 is provided with a knife blade having a cutting edge 62 that cooperates with the cutting edge 64 of a similar knife blade provided on the upper forward edge of the compression ram head 18 to shear off any waste material projecting above the head as it advances into the passage.

The charging ram head 18 has an overtravel into the chamber 32, for example eight inches or more, beyond the exit end of the charging passage 30 to compress the material in the chamber. After the chamber 32 has been filled with waste material compressed to a suitable density, the charging ram 20 is retracted so that the face of the head 18 is substantially flush with the corresponding side of the head 44 of the discharge ram 46. The discharge ram 46 then is advanced step-by-step to push the material out of the baling chamber 32 through the discharge passage 54 which retains the compressed material in its baled shape until it is tied. At each pause between incremental advances of the ram 46, the ejected material is tied with an encircling strap or wire, by strapping mechanism 66 (FIG. 1) located just outside the discharge passage 54, to prevent expansion of the compressed material and retain its baled configuration. As stated before, the operation of the machine 10 may be controlled automatically or manually.

As mentioned heretofore, problems may arise, however, in that too much waste material may be charged into the baling chamber 32 for the head 18 of the charging or compression ram 20 to push the last charge of the material completely out of the charging passage 30 into the chamber. In this event, part of the charge in the chamber 32 protrudes back into the charging passage 30, making it substantially impossible to eject the material in the chamber through the discharge passage 54 by the ejection or discharge ram 46. Heretofore, manual clearing of the jam was the only solution for the problem.

Figure 3:
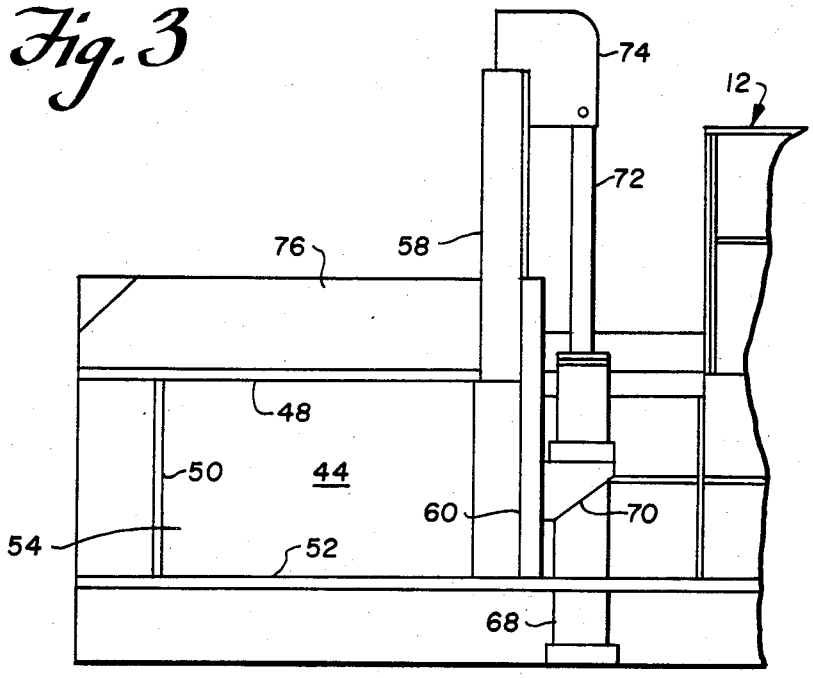
FIG. 3 is an enlarged fragmentary view of a portion of FIG. 2 but showing the bale release mechanism in open position to permit the ejection of an oversize bale.

The problem is easily overcome, however, by this invention. In the event that an oversize bale causes a discharge difficulty of the type described above, the inner section 58 of the side wall 56 of the discharge passage 54 is moved up until the bottom edge of that section is at least flush with or above the inner surface of the upper wall 48 of the discharge passage, as shown in FIG. 3, thus enlarging the width of that passage, on that side thereof adjacent the charging passage 30, sufficiently to permit ejection of the material in the chamber 32. After ejection, the side wall inner section 58 is moved back down to its normal operative position. The thickness of the inner wall section 58 may be of the order of 6" which is sufficient to enable ejection of an overwidth bale through a discharge passage which has a width normally of the order of 50".

Vertical movement of the inner wall section 58 between its oversize bale release and normal operating positions may be accomplished by any appropriate motor, such as a hydraulic cylinder 68 supported by brackets 70 in the exterior of the fixed side wall section 60 of the machine 10. The end of the piston rod 72 of the cylinder 68 is pinned to and between a pair of brackets 74 fastened to the upper edge of the movable wall section 58. The movable wall section 58, in its normal position, extends above the upper wall 48 of the discharge passageway 54 and is guided in its vertical movements both by the fixed wall section 60 and the vertical surface of a stiffener 76 on top of the upper wall 38 of the chamber 32, which surface is slidably engaged by the side edge of the movable wall section. Preferably, additional guiding of the movable wall section 58 is had by steps (FIG. 5) in the opposed wall sections 58, 60 forming interengaging vertical surfaces normal to the plane of the wall 56, one defined by a vertical recess 78 in the edge of the movable wall section 58 and the other by a vertical rib 80 on the fixed wall section 60.

It thus will be seen that the objects and advantages of this invention have been fully and effectively achieved. It will be realized, however, that the foregoing specific embodiment has been disclosed only for the purpose of illustrating the principles of this invention and is susceptible of modification without departing from such principles. Accordingly, the invention includes all embodiments encompassed within the spirit and scope of the following claims.

What is claimed is:

1. In a waste baling machine provided with a compression chamber of generally parallelopiped configuration having three fixed walls, a charging passage leading to and having an exit end at said chamber with a charging ram head reciprocable therein and defining in one position, a fourth chamber wall, a discharge passage defined by two pairs of opposed walls leading from said chamber at right angles to said charging passage, and an ejection ram head advanceable through said chamber and said discharge passage and defining in a retracted position a fifth chamber wall, the improvement comprising:

the discharge passage wall adjacent the exit end of said charging passage is divided into two sections, one inner and one outer, parallel to the plane of said discharge passage wall, said outer section being fixed and said inner section normally defining a part of said charging passage and being mounted for movement to enlarge said discharge passage throughout its length to permit ejection therethrough of an oversize charge of waste material in said chamber having a portion of said charge protruding back into said charging passage.

2. The machine defined in claim 1 in which the inner wall section is mounted for linear movement and including motor means connected thereto for moving the same between its normal position and a passage-enlarging position.

3. The machine defined in claim 2 including fixed guide means for the inner wall section to prevent movement thereof in directions parallel to movement of the ejection ram head.

4. The machine defined in claim 3 in which the passages extend horizontally.

* * * * *